US010858873B2

(12) United States Patent
Talpe

(10) Patent No.: US 10,858,873 B2
(45) Date of Patent: Dec. 8, 2020

(54) HYDRAULICALLY DAMPED, SELF-CLOSING HINGE

(71) Applicant: LOCINOX, Waregem (BE)

(72) Inventor: Joseph Talpe, Heestert (BE)

(73) Assignee: LOCINOX, Waregem (BE)

( * ) Notice: Subject to any disclaimer, the term of this patent is extended or adjusted under 35 U.S.C. 154(b) by 0 days.

(21) Appl. No.: 16/473,601

(22) PCT Filed: Dec. 22, 2017

(86) PCT No.: PCT/EP2017/084404
§ 371 (c)(1),
(2) Date: Jun. 25, 2019

(87) PCT Pub. No.: WO2018/122170
PCT Pub. Date: Jul. 5, 2018

(65) Prior Publication Data

US 2019/0330903 A1 Oct. 31, 2019

(30) Foreign Application Priority Data

Dec. 27, 2016 (EP) ..... 16206956

(51) Int. Cl.
*E05F 3/22* (2006.01)
*E05F 3/20* (2006.01)
(Continued)

(52) U.S. Cl.
CPC ..... *E05F 3/20* (2013.01); *E05D 3/02* (2013.01); *E05F 1/1207* (2013.01); *E05F 3/08* (2013.01); *E05F 3/12* (2013.01); *E05Y 2900/40* (2013.01)

(58) Field of Classification Search
CPC . Y10T 16/283; Y10T 16/304; Y10T 16/2771; Y10T 16/5387; Y10T 16/537;
(Continued)

(56) References Cited

U.S. PATENT DOCUMENTS 1,824,217 A * 9/1931 Kreiner ..... E05F 3/20 16/54
2,127,327 A * 8/1938 De Millar ..... E05F 3/08 16/54
(Continued)

FOREIGN PATENT DOCUMENTS

EP 1094185 A1 * 4/2001 ..... E05F 5/00
EP 2546442 A1 * 1/2013 ..... E05F 1/1223
(Continued)

OTHER PUBLICATIONS

International Preliminary Report on Patentability dated Jul. 2, 2019, issued in corresponding International Application No. PCT/EP2017/084404, filed Dec. 22, 2017, 1 page.
(Continued)

*Primary Examiner* — Chuck Y Mah
(74) *Attorney, Agent, or Firm* — Christensen O'Connor Johnson Kindness PLLC

(57) ABSTRACT

A hinge for coupling a closure member to a support includes a first hinge member and a second hinge member pivotably mounted on the first hinge member through the intermediary of two rolling bearings that are placed between different abutments. The hinge further includes a damping mechanism for damping a closing movement of the closure member; and an energy storing mechanism for storing energy when opening the closure member and using the energy to close the closure member. One of the rolling bearings supports the weight of a right-handed closure member while the other of the rolling bearings supports the weight of a left-handed closure member if the first hinge member is always fixed to the same element.

15 Claims, 10 Drawing Sheets

(51) Int. Cl.

| | |
|---|---|
| ***E05D 3/02*** | (2006.01) |
| ***E05F 1/12*** | (2006.01) |
| ***E05F 3/08*** | (2006.01) |
| ***E05F 3/12*** | (2006.01) |

(58) Field of Classification Search

CPC ..... Y10T 16/5373; Y10T 16/53888; Y10T 16/2766; E05F 1/066; E05F 1/1008; E05F 1/12; E05F 1/1207; E05F 1/1223; E05F 3/00; E05F 3/04; E05F 3/08; E05F 3/10; E05F 3/12; E05F 3/20; E05F 5/00; E05D 3/02; E05D 11/02; E05D 11/04; E05D 11/084; E05D 11/1014; E05D 7/12; E05D 2005/108; E05Y 2800/00; E05Y 2201/21; E05Y 2201/264; E05Y 2201/408; E05Y 2201/456; E05Y 2201/696; E05Y 2201/628; E05Y 2201/638; E05Y 2201/256; E05Y 2900/40; E05Y 2900/132

See application file for complete search history.

(56) References Cited

U.S. PATENT DOCUMENTS

| | | | | | |
|---|---|---|---|---|---|
| 2,456,537 | A * | 12/1948 | Seaman | E05F 3/10 | 16/54 |
| 4,155,144 | A * | 5/1979 | Koganei | E05F 3/20 | 16/54 |
| 4,829,628 | A * | 5/1989 | Vuksic | E05F 3/20 | 16/299 |
| 6,205,619 | B1 * | 3/2001 | Jang | E05D 5/10 | 16/352 |
| 6,658,694 | B2 * | 12/2003 | Wang | E05F 1/1223 | 16/284 |
| 6,854,161 | B2 * | 2/2005 | Lee | E05F 1/1223 | 16/50 |
| 8,468,650 | B2 * | 6/2013 | Talpe | F16F 9/19 | 16/58 |
| 8,752,244 | B2 * | 6/2014 | Talpe | E05F 3/14 | 16/58 |
| 2004/0068833 | A1 | 4/2004 | Sawa | | |
| 2009/0241289 | A1 * | 10/2009 | Choi | E05F 3/20 | 16/275 |
| 2009/0265889 | A1 | 10/2009 | Pan | | |
| 2017/0241180 | A1 * | 8/2017 | Bacchetti | E05D 3/02 | |

FOREIGN PATENT DOCUMENTS

| | | | | |
|---|---|---|---|---|
| WO | WO-9954583 | A2 * | 10/1999 | E05F 1/12 |
| WO | 2014054028 | A1 | 4/2014 | |

OTHER PUBLICATIONS

International Search Report and Written Opinion of the International Searching Authority dated Apr. 16, 2018, issued in corresponding International Application No. PCT/EP2017/084404, filed Dec. 22, 2017, 9 pages.

* cited by examiner

HYDRAULICALLY DAMPED, SELF-CLOSING HINGE

BACKGROUND OF THE INVENTION

The present invention relates to a hydraulically damped, self-closing hinge for hinging a closure member to a support. The hinge comprises: a first hinge member comprising a first barrel and a first leaf fixed to said first barrel and configured to be fixed to one of: the support and the closure member; a second hinge member pivotably mounted on the first hinge member through the intermediary of a first and a second rolling bearing, the second hinge member comprising a second barrel and a second leaf fixed to said second barrel and configured to be fixed to the other one of: the support and the closure member; a damping mechanism interposed between said hinge members and configured for damping a closing movement of said closure member, the damping mechanism comprising: a closed cylinder cavity that has a longitudinal direction and is filled with a volume of hydraulic fluid; a damper shaft having a first end extending into the cylinder cavity; a piston within said cylinder cavity so as to divide the cylinder cavity into a high pressure compartment and a low pressure compartment, the piston being operatively coupled to said damper shaft to be movable between two extreme positions in said longitudinal direction; a one-way valve allowing fluid flow from the low pressure compartment to the high pressure compartment when said closure member is being opened; and at least one restricted fluid passage between the compartments; and an energy storing mechanism interposed between said hinge members and configured for storing energy when said closure member is being opened and for using said energy to effect closure of said closure member, the energy storing mechanism being contained in said second barrel.

Such a hinge is commercially available as the "MAMMOTH-180" sold by "Locinox" and is intended to hinge a gate, in particular an industrial gate, to a support. The hinge is formed as a flush hinge with the second hinge member formed by one knuckle with a leaf and located between the first hinge member formed by two further knuckles which are connected to one another by a further leaf. The energy storing mechanism comprises a torsion spring which is located in the knuckle of the second hinge member and is connected on one side to the first hinge member and on the other side to the second hinge member. The damping mechanism is located in the lowermost knuckle of the first hinge member and comprises a rotating damping shaft that drives a piston to move in a hydraulic fluid. To ensure a proper alignment of the hinge members two rolling bearings are provided in between the two hinge members at respective ends of the second hinge member. These rolling bearings also aid in a smooth pivoting motion of the hinge members with respect to one another.

In order to bear the load of gates, having in particular a weight of up to 150 kg, both the spring mechanism and the damper mechanism need to handle large forces. As such, due to the construction of the hinge in the form of a flush hinge it is quite large and voluminous.

Another downside of the known hinge is that the first leaf is configured for being fixed in a fixed position with respect to the support or the gate whilst the second leaf is configured to enable adjusting the distance between the support and the gate. Depending on which type of closure member, i.e. right-handed or left-handed, the first hinge member is fixed to either the support or the closure member respectively. This is due to the fact that the hinge is always mounted in the same upright position, and never upside down, in order to avoid leakage of hydraulic fluid. Therefore, when used for differently oriented closure members, the hinges provide an asymmetrical view as only the leaf of the second hinge member enables adjusting the distance between the support and the gate.

SUMMARY OF THE INVENTION

It is an object of the present invention to provide a hydraulically damped, self-closing hinge which is more compact and which, in particular, does not need a hinge member with two knuckles to provide the required strength to be able to support relatively heavy closure members.

This object is achieved according to the invention in that said first barrel has a main body and a hollow shaft extending from said main body with the damper shaft extending through the hollow shaft, the second barrel being pivotably mounted on said hollow shaft through the intermediary of said rolling bearings each having an inner race and an outer race, the inner races of said rolling bearings radially engaging an outer surface of said hollow shaft, the outer races of said rolling bearings radially engaging an inner surface of said second barrel, the inner race of the first rolling bearing being axially engaged by a first abutment on said first barrel, the inner race of the second rolling bearing being axially engaged by a second abutment fixed onto said hollow shaft, the outer race of the first rolling bearing being axially engaged by a third abutment on the inner surface of said second barrel, the outer race of the second rolling bearing being axially engaged by a fourth abutment on the inner surface of said second barrel.

By placing the rolling bearings between the different abutments, one of the rolling bearings will support the weight of a right-handed closure member while the other of the rolling bearings will support the weight of a left-handed closure. Moreover, due to the damper shaft being placed through the hollow shaft, the pivoting motion of the hinge members relative to one another is transferred to the damping mechanism internally thus avoiding the necessity of having three knuckles with a leaf connecting two of the knuckles. As such, the hinge is able to be formed as a barrel hinge having only two knuckles, with the first knuckle being formed by the first barrel and the second knuckle being formed by the second barrel, which is a more compact hinge than a flush hinge. Moreover, as none of the leaves has to connect two knuckles each of them may have a height which corresponds to the height of one of the barrels or, in other words, both leaves can be given a same height to obtain a symmetric view. The height of the leaves can thus be reduced to achieve a more elegant hinge, notwithstanding the fact that it contains an energy storing mechanism and a damping mechanism which is configured for actuating a relatively heavy closure member.

The first leaf can be arranged for being fixed to the support, in particular so that the barrels of the hinge are on a predetermined fixed distance from the support, whilst the second hinge is arranged for being fixed to the closure member, in particular in such a manner that the distance between the support and the gate can be adjusted. As such, for a right-handed closure member, the weight of the closure member is transferred through the second hinge member, via the third abutment, onto the outer race of the first rolling bearing which then transfers the weight, via its inner race and the first abutment, to the first hinge member fixed to the support. Alternatively, the second leaf can be arranged for being fixed to the support, in particular so that the barrels of the hinge are on a predetermined fixed distance from the support, whilst the second hinge is arranged for being fixed to the closure member, in particular in such a manner that the distance between the support and the gate can be adjusted. As such, for a right-handed closure member, the weight of the closure member is transferred through the first hinge member, via the first abutment, onto the inner race of the first rolling bearing which then transfers the weight, via its outer race and the third abutment, to the second hinge member fixed to the support. As such, for a right-handed closure member, the first rolling bearing supports the weight of the closure member.

Similarly, for a left-handed closure member the first leaf can be arranged for being fixed to the support with the second leaf being arranged for being fixed to the closure member, i.e. the hinge is turned upside down with respect to its mounting position for a right-handed closure member. As such, the weight of the closure member is transferred through the second hinge member, via the fourth abutment, onto the outer race of the second rolling bearing which then transfers the weight, via its inner race and the second abutment, to the first hinge member fixed to the support. Alternatively, for a left-handed closure member, the first leaf can be arranged for being fixed to the closure member with the second leaf being arranged for being fixed to the support, i.e. the hinge is turned upside down with respect to its mounting position for a right-handed closure member. As such, the weight of the closure member is transferred through the first hinge member, via the second abutment, onto the inner race of the second rolling bearing which then transfers the weight, via its outer race and the fourth abutment, to the second hinge member fixed to the support. As such, for a left-handed closure member, the second rolling bearing supports the weight of the closure member.

Moreover, for differently oriented closure members, the hinge is always fixed with one and the same hinge member to the support and with the other hinge member to the closure member, i.e. the hinge is turned upside down for differently oriented closure members, thereby providing a symmetric view. In particular, the hinge axis of the hinge according to the present invention is always aligned with the support, i.e. is always in the same position with respect to the support.

CN-U-201372657 discloses a barrel hinge with a damping mechanism and an energy storing mechanism wherein the damper shaft runs through a hollow shaft thereby forming a more compact hinge. The two hinge members are connected to one another via the damper shaft which sticks out of the lower member and is fixed to the upper member with the bearings that enable both hinge members to rotate with respect to one another being applied onto the damper shaft. As such, the bearings do not carry the weight of the closure member. Instead, the closure member, which is fixed to the upper hinge member, is supported by pads resting on the lower hinge member. A drawback of such an arrangement is that the pads produce more friction than, for example, a rolling bearing. Moreover, due to the limited diameter of the damper shaft, the bearings applied around the damper shaft do not provide the required strength to enable the barrel hinge to support a relatively heavy closure member, such as a gate. In the hinge according to the present invention, on the contrary, the bearings are not applied around the damper shaft but around the hollow shaft which surrounds the damper shaft and which therefore has a larger diameter. Consequently, the forces applied onto the bearings are distributed over a larger surface thus producing less pressure and stresses in the hinge. A final drawback of the hinge disclosed in CN-U-201372657 is that it is not suitable to be mounted upside down.

In an embodiment of the present invention said third and fourth abutments are located between said rolling bearings and said rolling bearings are located between said first and second abutments.

In an embodiment of the present invention the inner surface of the second barrel has a collar facing the outer surface of said hollow shaft, the third and fourth abutments being formed by two lateral surfaces of the collar.

In an embodiment of the present invention said second abutment is formed by a ring that is applied over said hollow shaft.

In an embodiment of the present invention said first abutment is formed by a ledge on the outer surface of said hollow shaft.

In an embodiment of the present invention the energy storing mechanism comprises a first and a second actuation member and a spring mechanism arranged between both actuation members, the actuation members being rotatable with respect to one another around a rotation axis in a first mutual direction to store said energy in said spring mechanism and in a second mutual direction, which is opposite to said first mutual direction, to restore said energy. Preferably, the first actuation member is irrotatably fixed to said second barrel and the second actuation mechanism is irrotatably fixed to said first barrel.

The spring provides a simple design to store energy from the pivoting motion of the hinge members.

In an embodiment of the present invention the first and the second rolling bearing are ball bearings.

The ball bearings provides a simple but strong design to support the closure member and to enable rotation between the hinge members.

In an embodiment of the present invention said damper shaft is rotatable around a rotation axis that extends substantially in said longitudinal direction with said first end having an end face and a portion with a non-circular cross-section, the damping mechanism comprising a spindle made of a synthetic material and having a recess with a non-circular cross-section fitting onto said portion of the damper shaft, the spindle being fixed onto said first end of the damper shaft and having an outer threaded portion with a screw axis which coincides with the rotation axis of the damper shaft, the piston having an inner threaded portion with a screw axis which also coincides with the rotation axis of the damper shaft, the outer threaded portion of the spindle on the damper shaft being in engagement with the inner threaded portion of the piston to operatively couple the piston to said damper shaft.

The spindle provides a simple design to transfer the rotation of the damper shaft into a translation of the piston.

In a preferred embodiment of the present invention said recess in the spindle has a bottom which engages said end face of the damper shaft, the spindle being fixed to the damper shaft by at least one bolt that is bolted through the bottom of the spindle into the end face of the damper shaft, the at least one bolt having a head which is sunk into the bottom of the spindle and being offset with respect to said rotation axis to irrotatably fasten the spindle to the damper shaft.

By fastening the spindle to the damper shaft by at least one bolt that is bolted through the bottom of the spindle into the end face of the damper shaft and that is offset with respect to the rotation axis and has a head which is sunk into the spindle, the at least one bolt also transfers a rotational motion of the damper shaft to the spindle. As such, less force is exerted onto the recess with the non-circular cross-section in the spindle which is thus less prone to wear out and cause leeway between the piston and the damper shaft.

In a further preferred embodiment of the present invention a third rolling bearing is provided between the rotating damper shaft and said first barrel, said third rolling bearing aligning the damper shaft with said hollow shaft. Preferably, the third rolling bearing is a ball bearing.

The third rolling bearing provides a smooth and easy rotation between the damper shaft and the first barrel and also aligns the damper shaft with the hollow shaft. As such, a tight seal can be provided around the damper shaft such that, if the hinge is mounted upside down, no hydraulic liquid will escape by gravity along the rotating damper shaft.

In an embodiment of the present invention the hinge comprises a pressure compensation mechanism for compensating changes of the volume of said hydraulic fluid upon temperature variations thereof, the pressure compensation mechanism comprising an expansion channel with a plunger that fits into the expansion channel and is slidably received therein, the plunger dividing the expansion channel into a first compartment which is in fluid communication with said cylinder cavity and a second compartment that is sealed off from the first compartment by said plunger, the second compartment allowing the plunger to slide within the expansion channel to compensate said changes of the volume of the hydraulic fluid.

The expansion channel provides sufficient space to allow the hydraulic fluid to expand without resulting in excessive pressures that could damage the closed cylinder cavity even for large outdoors temperature variations. As such, the actuator is more resistant to temperature variations.

In a preferred embodiment of the present invention said second compartment comprises a biasing member urging the plunger towards said second compartment to pressurize the hydraulic fluid.

The biasing member exerts a pressure on the hydraulic fluid thereby alleviating the effects caused by negative pressures in the hydraulic fluid that act on at least one sealing ring in the hydraulic actuator, which negative pressures could cause air or gas to be sucked into the closed cylinder cavity via the at least one sealing ring.

In a further preferred embodiment of the present invention said first compartment of the expansion channel is part of said low pressure compartment.

By fluidly connecting the expansion channel with the low pressure compartment, the plunger and the spring in the expansion channel are not exposed to the high pressures when closing the closure member. Furthermore, if the expansion channel would be fluidly connected to the high pressure compartment this would affect the normal operation of the damping mechanism.

BRIEF DESCRIPTION OF THE DRAWINGS

The invention will be further explained by means of the following description and the appended figures.

DETAILED DESCRIPTION OF THE INVENTION

The present invention will be described with respect to particular embodiments and with reference to certain drawings but the invention is not limited thereto but only by the claims.

Furthermore, the various embodiments, although referred to as "preferred" are to be construed as exemplary manners in which the invention may be implemented rather than as limiting the scope of the invention.

The invention generally relates to a hydraulically damped actuator for closing a closure member 1 hinged to a support 2. The closure member 1 may be a door, a gate or a window, in particular an outdoors door or gate that may be subjected to large temperature variations. The support 2 may, for example, be a wall or a post. The actuator comprises a first and a second connection element, the first connection element being configured to connect the actuator to the support 2 and the second connection element being configured to connect the actuator to the closure member 1. The actuator further comprises an energy storing mechanism and a damping mechanism, both of which are operatively connected with the closure member 1 and the support 2 via the first and second connection elements. The energy storing mechanism is configured for storing energy when the closure member 1 is being opened and for restoring the energy to effect closure of the closure member 2. The damping mechanism is configured for damping a closing movement of the closure member 1.

Figure 1A:
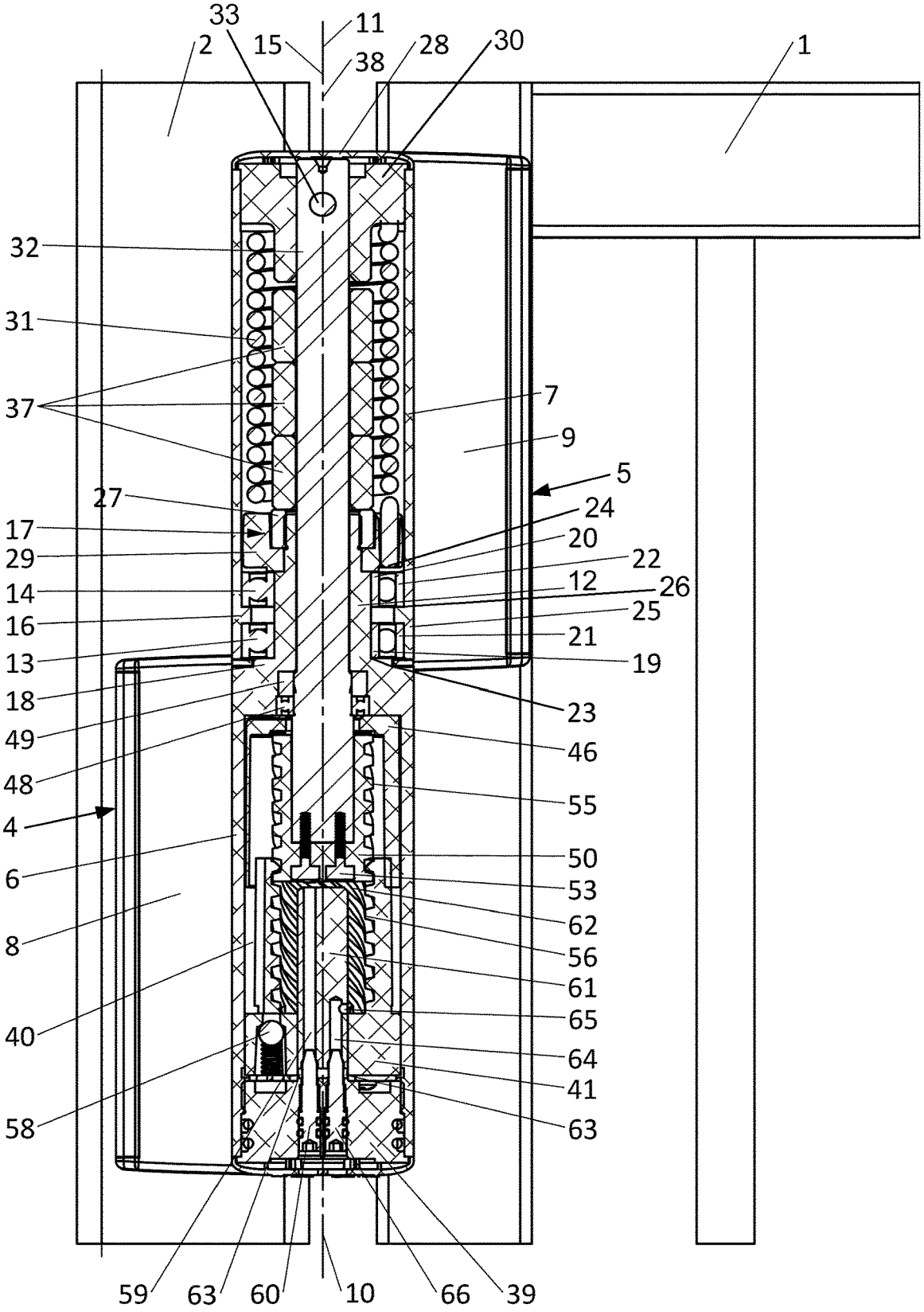
FIGS. 1A and 1B show a longitudinal cross-section of a hinge of the present invention mounted on a support and a left-handed and a right-handed closure member in the closed position of the closure member.
Figure 1B:
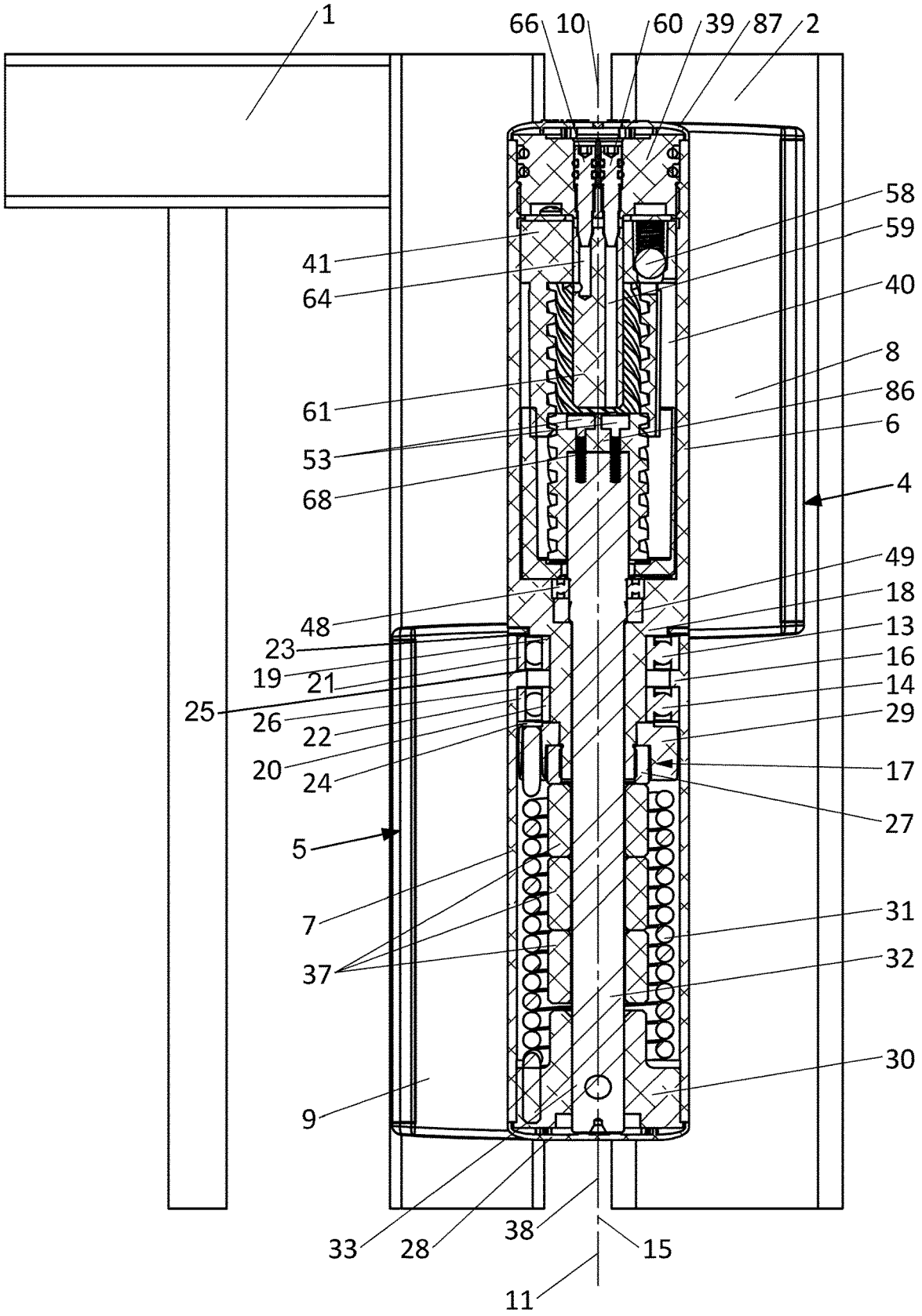

The actuator is provided in the form of a hinge as illustrated in FIGS. 1A and 1B. In other words, the closure member 1 is hinged to the support 2 by means of a hydraulically damped, self-closing hinge. The hinge comprises a first and a second hinge member 4, 5 with the first hinge member 4 being fixed to the support 2 and the second hinge member 5 being fixed to the closure member 1 for both a right-handed and a left-handed closure member 1 as illustrated in FIGS. 1A and 1B respectively. In other words, the hinge is turned upside down for a left-handed closure member 1 with respect to its orientation for a right-handed closure member 1. Therefore, the first hinge member 4 may also be referred to as the fixed hinge member 4 and the second hinge member may also be referred to as the moveable hinge member 5.

As illustrated in FIGS. 1A and 1B, the fixed hinge member 4 comprises a first barrel 6 fixed to a first leaf 8, also referred to as the fixed barrel 6 and the fixed leaf 8, while the moveable hinge member 4 comprises a second barrel 7 fixed to a second leaf 9, also referred to as the moveable barrel 7 and the moveable leaf 9. The leaves 8, 9 are used to fix the hinge to the closure member 1 and to the support 2 while the barrels 6, 7 function as the knuckles of the hinge and also house the energy storing and the damping mechanisms. In particular, as illustrated in FIGS. 4A and 4B, the fixed leaf 8 is angled to match an angle of the support 2 so as to be always fixed in a same position with respect to the support, i.e. in order to be always aligned with the other hinge used to hinge the closure member to the support.

Preferably, the moveable leaf 9 is arranged such that it is possible to move the hinge, in particular the hinge axis of the hinge, closer and further away with respect to the closure member 1 and the fixed leaf 9 is arranged such that it is possible to adjust the height of the closure member 1 with respect to the support 2. In an embodiment, the fixed leaf 8 comprises horizontal grooves 77 that are placed above one another (shown in FIG. 4B) that cooperate with grooves on mounting plates applied underneath the heads of the bolts 80 used to mount the fixed leaf 8 onto the support 2. The fixed leaf 9 also has two vertical slots (not shown), on above the other, for receiving the bolts 80. The cooperating grooves and the vertical slots enable to move the closure member 1 higher and/or lower with respect to the support 2. Similarly, the moveable leaf 9 comprises vertical grooves 78 that are placed sideways with respect to one another and horizontal slots 88 (shown in FIG. 4A). The vertical grooves 78 cooperate with grooves on mounting plate applied underneath the heads of the bolts 80 used to mount the moveable leaf 9 onto the closure member 1. These cooperating grooves and horizontal slots 88 enable to move the closure member 1 closer and/or further away with respect to the support 2.

Figure 4A:
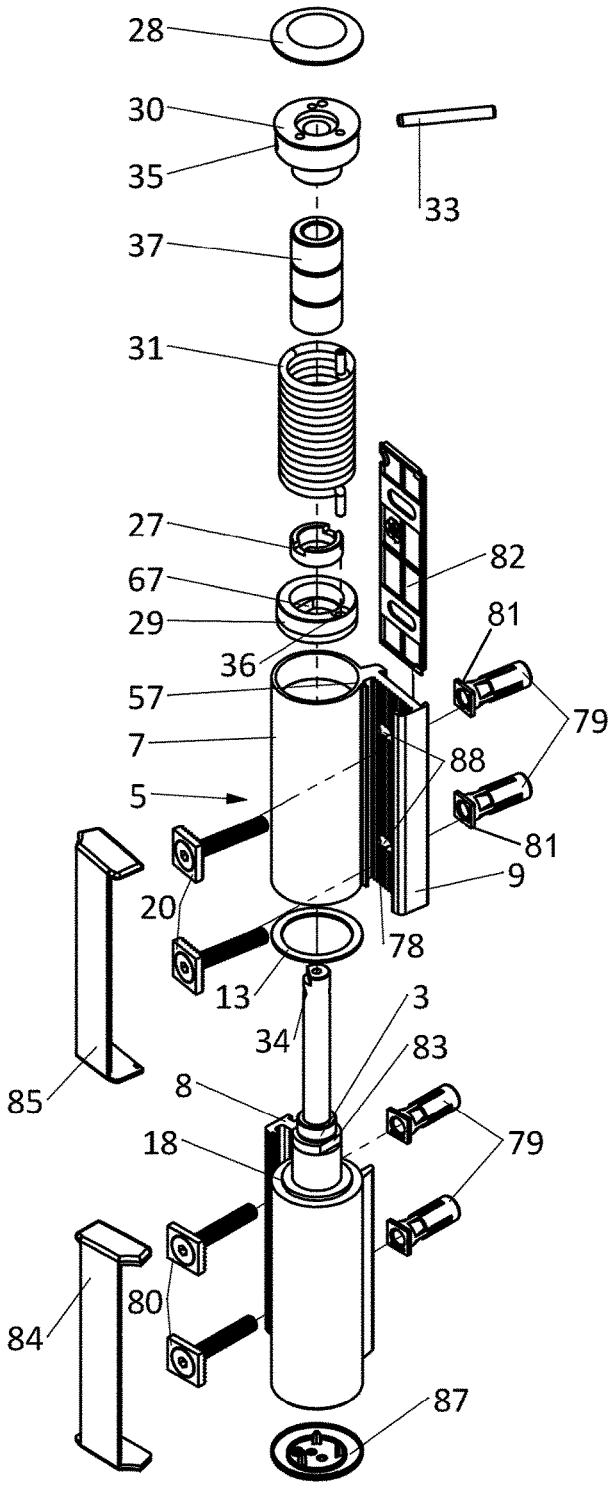
FIG. 4A shows a partly exploded view of the complete hinge.
Figure 4B:
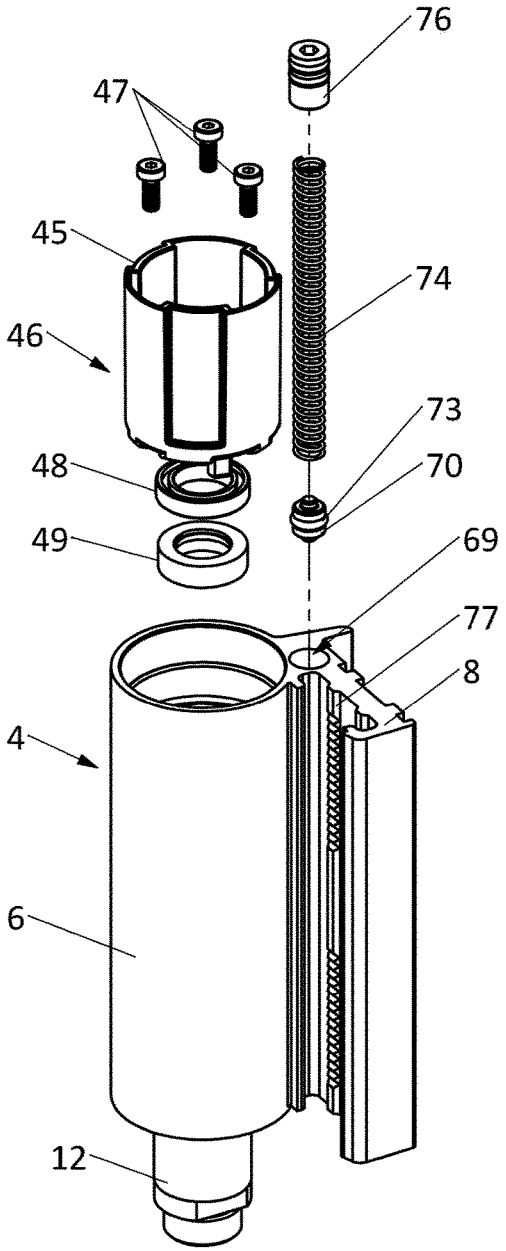
FIG. 4B shows a partly exploded view of the first hinge member.

The leaves 8, 9 are preferably fixed to the support 2 and the closure member 1 respectively using fixture sets as described in EP-B-1907712, i.e. by inserting bolts 80 through fixation elements 81 into nut elements 79 that automatically fasten due to a square cross-section that fits into a square section (not shown) of a locking plate 82 (shown in FIG. 4A).

In the illustrated embodiments, each of the leaves 8, 9 is covered with a cover cap 84, 85 to cover the grooves 77, 78 and the fixture sets 79, 80.

In a preferred embodiment, the hinge members 4, 5 are extruded profiles with certain sections being milled and/or grinded away to form ledges, collars, protrusions, etc.

Preferably, the hinge members 4, 5 are manufactured from extruded aluminium which is less porous as cast aluminium so that it is leak-free with respect to hydraulic fluid.

FIGS. 1A and 1B show a longitudinal cross-section of the hydraulically damped, self-closing hinge mounted on a closed right-handed and a closed left-handed closure member 1 respectively. Both barrels 6, 7 have a longitudinal direction 10, 11, which longitudinal directions 10, 11 are preferably substantially the same. The moveable barrel 7 is pivotably mounted onto a hollow shaft 12 that forms a part of the fixed barrel 6 using two ball bearings 13, 14. The barrels 6, 7 thus act as knuckles of the hinge with the moveable barrel 7 being pivotable with respect to the fixed barrel 6 around a pivot axis 15 which, preferably, extends in the longitudinal directions 10, 11.

The ball bearings 13, 14 together with a fixed collar 16 on the inner surface of the moveable barrel 7, a ring 17 fixed onto the hollow shaft 12 and a ledge 18 on the fixed barrel 6 act as the pin of the hinge to keep the two hinge members 4, 5 fixed to one another and to enable a pivoting motion of the two hinge members 4, 5 with respect to one another.

Specifically, the inner races 19, 20 of the ball bearings 13, 14 radially contact the outer surface of the hollow shaft 12 and the outer races 21, 22 of the ball bearings radially contact the inner surface of the moveable barrel 7. The ball bearings 13, 14 thus enable a pivoting motion of the moveable barrel 7 with respect to the hollow shaft 12 and thus with respect to the fixed barrel 6.

The first inner race 19, i.e. the inner race 19 of the first ball bearing 13, axially engages with the ledge 18 of the fixed barrel 6 and the first outer race 21, i.e. the outer race 21 of the first ball bearing 13, axially engages with the collar 16. Therefore, for the right-handed closure member 1 illustrated in FIG. 1A, there is the following chain of support. The first hinge member 4 is fixed to and supported by the support 2; the first ball bearing 13 is supported by the first hinge member 4 as the first inner race 19 rests upon a first abutment 23 formed by the ledge 18 of the fixed barrel 6; the first ball bearing 13 supports the second hinge member 5 as a third abutment 25 formed by the collar 16 rests upon the first outer race 21; and the closure member 1 is fixed to and supported by the second hinge member 5. As such, for a right-handed closure member 1 to which the second hinge member 5 is fixed, the closure member 1 is supported via the first ball bearing 13.

The second inner race 20, i.e. the inner race 20 of the second ball bearing 14, axially engages with the ring 17 that is fixed to the hollow shaft 12 of the fixed barrel 6 and the second outer race 22, i.e. the outer race 22 of the second ball bearing 14, axially engages with the collar 16. Therefore, for the left-handed closure member 1 illustrated in FIG. 1B, there is the following chain of support. The first hinge member 4 is fixed to and supported by the support 2; the second ball bearing 14 is supported by the first hinge member 4 as the second inner race 20 rests upon a second abutment 24 formed by the ring 17 of the fixed barrel 6; the second ball bearing 14 supports the second hinge member 5 as a fourth abutment 26 formed by the collar 16 is supported by the second outer race 22; and the closure member 1 is fixed to and supported by the second hinge member 5. As such, for a left-handed closure member 1 to which the second hinge member 5 is fixed, the closure member 1 is supported via the second ball bearing 14.

It will be appreciated that, although the ball bearings 13, 14 have been described as engaging various surfaces, in other embodiments, various spacer elements may be interposed between the ball bearings 13, 14 and the respective abutments 23, 24, 25, 26 and the outer surface of the hollow shaft 12 and the inner surface of the moveable barrel 7.

Moreover, in other embodiments, one or both the ball bearings 13, 14 may be replaced by a same number of rolling bearings including but not limited to cylindrical roller bearings, spherical roller bearings, gear bearings, tapered rolling bearings and needle roller bearings.

Furthermore, it will be appreciated that the collar 16 which acts as both the third and fourth abutments 25, 26 may be implemented in various alternative ways. For example, the collar 16 may be split into two parallel collars by an annular groove; the collar 16 may be discontinuous, e.g. a ring of protrusions from the inner surface of the moveable barrel 7 may also form the collar 16; axial protrusions may be provided onto the collar 16 in which case the third and fourth abutments 25, 26 are formed by these projections; etc. Similarly, the first abutment 23 formed by the ledge 18 on the fixed barrel 6 may also be formed by a further collar on the outer surface of the hollow shaft 12 or may be formed by multiple protrusions therefrom or by axial protrusions from the ledge 18. One continuous collar 16 on the inner surface of the moveable barrel is however preferred. This collar is preferably part of the extruded profile and is produced by widening the boring in the extruded profile above and below the collar so that the collar remains. In this way, a strong collar is obtained, which is made of extruded aluminium and which can resist high stresses.

In the illustrated embodiment, the ring 17 is formed by an actuation member of the energy storing mechanism (as described below) which is fastened to the hollow shaft 12 by a ring screw or nut 27 that is screwed onto a threaded portion 3 of the hollow shaft 12 (as illustrated in FIG. 4A). Preferably, the threaded portion 3 is located at the free end of the hollow shaft 12. The actuation member of the energy storing mechanism is rotatably locked with respect to the hollow shaft 12 by having a non-circular cross-section, in particular a flat side 67 as illustrated in FIG. 4A that abuts with a corresponding flat side 83 of the hollow shaft 12.

The configuration of the ball bearings 13, 14, the ledge 18 and the ring 17 is advantageous as it allows the hinge to be easily assembled. In particular, the fixed hinge member 4 is assembled first with the first ball bearing 13 being placed around the hollow shaft 12. Afterwards, the moveable hinge member 5 is placed onto the hollow shaft 12 with the collar 16 resting on the first ball bearing 13. The second ball bearing 14, together with the other internal elements in the moveable hinge member 5, are then placed via an opening in the top of the moveable hinge member 5 which is finally sealed with a second end cap 28.

The energy storing mechanism is contained in the moveable barrel 7 and comprises a first actuation member 29 formed by the ring 17, a second actuation member 30 and a torsion spring 31 connected with one end to the first actuation member 29 and with the other end to the second actuation member 30. The second actuation member 30 is ring-shaped and placed onto the free end of a damper shaft 32. The second actuation member 30 is rotatably locked to the moveable barrel 7 and the damper shaft 32 by a pin 33 (shown in FIG. 4A) that is placed in respective openings 34, 35, 57 in the damper shaft 32, the first actuation member 29 and the moveable hinge member 5 (shown in FIG. 4A). The second actuation member 30 further comprises a hole (not shown) in which an end of the torsion spring 31 is placed. In this way, the moveable barrel 7, the second actuation member 30, the damper shaft 32 and one end of the torsion spring 31 are all irrotatably coupled to one another and to the closure member 1. The first actuation member 29, formed by the ring 17, is irrotatably fixed to the hollow shaft 12, and thus to the fixed barrel 6, by the ring screw 27. The first actuation member 29 further comprises a hole 36 (shown in FIG. 4A) in which the other end of the torsion spring 31 is placed. This end of the torsion spring 31 is thus irrotatably coupled to the fixed hinge member 4 and thus to the support 2.

In a preferred embodiment, the energy storage mechanism also comprises padding to prevent the spring 31 from buckling due to the large forces exerted thereon. In the illustrated embodiments, the padding comprises three rings 37 placed around the damper shaft 32 in the opening between the damper shaft 32 and the torsion spring 31. The padding rings 37 are free to rotate with the damper shaft 32 and do not contact the torsion spring 31 thus causing no significant friction.

The damper shaft 32 provides the coupling between the energy storing mechanism and the damping mechanism, and more generally, transfers the opening and closing movement of the closure member 1 to the damping mechanism. The damper shaft is rotatable around a rotation axis 38 that is preferably substantially the same as the pivot axis 15 and the longitudinal directions 10, 11. The damper shaft 32 extends through the hollow shaft 12, as such entering the fixed barrel 6 in which the damping mechanism is housed.

The hydraulic damper mechanism comprises the fixed barrel 6 which forms a part of the fixed hinge member 4 and which is closed off at the bottom by an oil cap 39 to define a closed cylinder cavity 40. This cylinder cavity 40 has a longitudinal direction which is the same as the first longitudinal direction 10. The damper mechanism further comprises a piston 41 placed in the fixed barrel 6 to divide the cylinder cavity 40 into a high pressure compartment 42 and a low pressure compartment 43 (illustrated in FIGS. 2A, 2D, 3A and 3D).

Figure 5B:
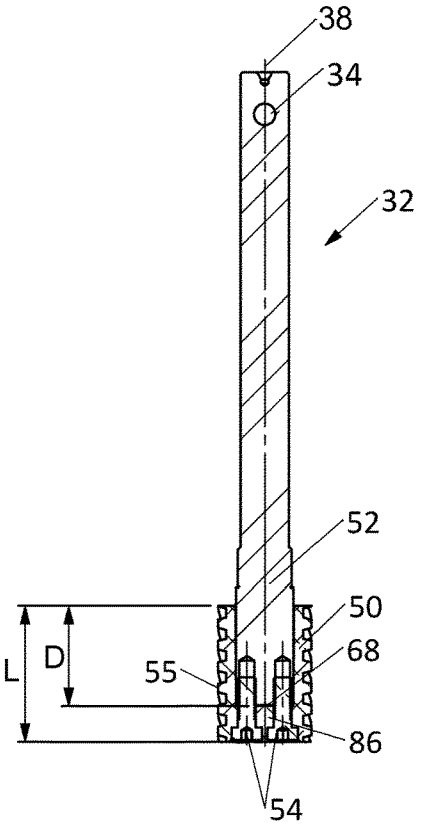
FIG. 5B shows a detailed cross-section of the spindle connected to the damper shaft.
Figure 5A:
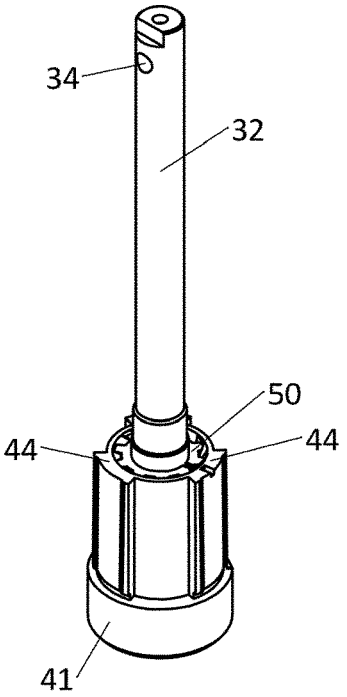
FIG. 5A shows a perspective view of the damper shaft and the piston.

A perspective view of the damper shaft 32 and the piston 41 placed thereon is shown in FIG. 5A, which illustrates that the piston 41 has three outward projections 44 which are guided in three grooves 45 in a base element 46 (shown in FIG. 4B) which is also arranged in the cylinder cavity 40. The base element 46 fits in the fixed hinge member 4 and is irrotatably locked therein by means of three bolts 47 (shown in FIG. 4B) which are bolted into corresponding holes in the top of the fixed hinge member 4. By such a configuration, the piston 41 can substantially not rotate within the fixed barrel 6 and is slidable in the longitudinal direction 10 of the cylinder cavity 40 between two extreme positions, namely a closed position illustrated in FIGS. 1A and 1B and an open position illustrated in FIGS. 2B, 2C, 3B and 3C.

The hydraulic damper mechanism further comprises the rotating damper shaft 32. As can be seen in FIGS. 1A and 1B and as described above, the rotating damper shaft 32 is irrotatably coupled to the moveable hinge member 5. The damper shaft 32 therefore rotates together with the closure member 1. In particular, the damper shaft 32 rotates over substantially the same angle with respect to the fixed barrel 6 as the angle over which the moveable hinge member 5 rotates with respect to the fixed hinge member 4.

As illustrated in FIGS. 1A and 1B, at one end, the damper shaft 32 enters the low pressure compartment 43 of the cylinder cavity 40 through the side of the fixed barrel 6, i.e. the hollow shaft 12. A third bearing 48 and a seal 49 are provided between the damper shaft 32 and the fixed hinge member 4, as also illustrated in the exploded view of FIG. 4B. The third bearing 48 provides a smooth and easy rotation between the damper shaft 32 and the fixed barrel 6 and also aligns the damper shaft 32 with the hollow shaft 12 with a tolerance of less than 100 μm, preferably less than 20 μm. As such, friction and wear of the seal 49 can be kept to a minimum so that it remains liquid tight even after prolonged use. The hinge can thus be mounted upside down without hydraulic liquid escaping by gravity along the rotating damper shaft 32.

In order to convert the rotational motion of the damper shaft 32 into a translational motion of the piston 41 in the cylinder cavity 40, a spindle 50 is provided between the damper shaft 32 and the piston 41, which spindle is preferably made of a synthetic material which can easily be moulded into the required shape. Preferably, the spindle 50 is injection moulded from a thermoplastic material. Specifically, the spindle 50 is mounted onto an end 52 of the damper shaft 32. In order to convert the rotational motion of the spindle 50 into a translational motion of the piston 41 in the cylinder cavity 40, the spindle 50 is provided with an outer threaded portion 55 that engages an inner threaded portion 56 on the piston 41. Specifically, the outer threaded portion 55 is provided with a first, external (male) screw thread which has a screw axis which substantially coincides with the rotation axis 38 of the damper shaft 32 and which co-operates with an internal (female) screw thread on the piston 41. Since the piston 41 is irrotatably fixed within the fixed barrel 6, via the upward projections 44 and grooves 45, the piston 41 slides with respect to the fixed barrel 6. In particular, the piston 41 moves towards the damper shaft 32 when the closure member 1 is opened and it moves away from the damper shaft 32 when the closure member 1 is closed. In the illustrated embodiments, the screw threads are therefore right-handed screw threads.

To keep the hinge as compact as possible, no gearing or reduction is provided between the damper shaft 32 and the piston 41. As such, the threaded portions 55, 56 have a screw thread with a high lead angle. Preferably, the outer threaded portion 55 has a lead angle of at least 45° and more preferably at least 55° and most preferably at least 60°. In the illustrated embodiment, the lead angle is equal to about 66°. Moreover, the outer threaded portion 55 preferably has at least 5 starts and more preferably at least 7 starts and 10 starts in the illustrated embodiments. The larger lead angle increases the amount of force that is exerted onto the spindle 50 when transferring a rotation from the damper shaft 32 to a sliding motion of the piston 41. These large forces are known to lead to a deformation of the spindle 50 after a period of time.

Figure 5C:
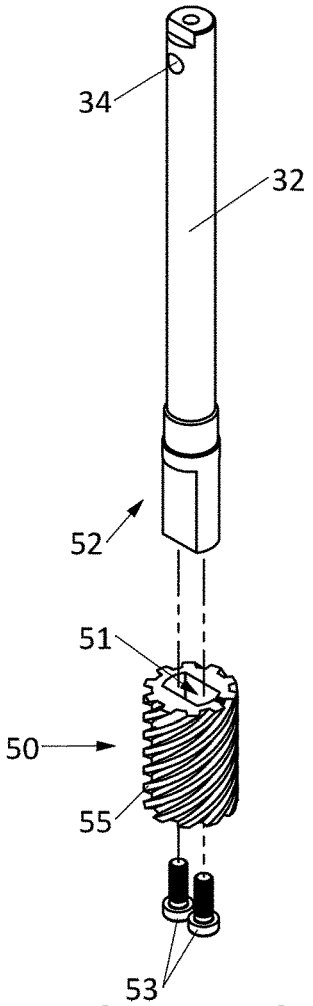
FIG. 5C shows an exploded view of the damper shaft and the spindle illustrated in FIG. 5B.

To counter such problems, the spindle 50 is irrotatably coupled to the damper shaft 32 in two ways as shown in the exploded view of FIG. 5C. First, the spindle 50 is provided with a recess 51 having a non-circular cross-section, specifically, with two flat sections. The proximal end 52 of the damper shaft 32 is provided with a corresponding non-circular cross section on which the spindle 50 is mounted. Moreover, the spindle 50 is fastened to the end face 68 of the damper shaft 32 with two bolts 53. The bolts 53 are bolted through a bottom 86 of the spindle 50 into the end face 68 of the damper shaft 32 as illustrated in the cross-sectional view of FIG. 5B. In particular, each of the bolts 53 is offset with respect to the rotation axis 38 of the damper shaft 32 and has a head 54 that is sunk into the spindle 50. The head 54 of the bolt 53 used to fix the spindle 50 to the damper shaft 32 has, in general, a circular cross-section so that it can engage the inner wall of the recess in the bottom of the spindle wherein it is received. Preferably, the lateral side of the circular head has a height which is equal to at least 1 mm, more preferably of at least 2 mm. In this configuration, the bolts 53 transfer a significant part of the rotation of the damper shaft 32 to the spindle 50 causing a significant decrease in pressure on the recess 51 and thus a lower chance that the plastic spindle 50, in particular the recess 51 therein, may be deformed due to excessive forces on the spindle 50.

It will be readily appreciated that only one bolt 53, or more than two bolts 53, may also be provided to fix the spindle 50 to the damper shaft 32 as long as the bolt(s) 53 is/are offset with respect to the rotation axis 38 of the damper shaft 32 and thus transfer(s) a significant part of the rotation of the damper shaft 32 to the spindle 50.

In the illustrated embodiments, the bolts 53 are bolted in a direction that is substantially parallel to the rotation axis 38 of the damper shaft, but it will be appreciated that other orientations of the bolts 53 are also possible. For example, the bolts 53 could be angled with respect to the damper shaft 32.

In the illustrated embodiments, the spindle 50 has the overall shape of a cup that is filled by the end 52 of the damper shaft 32. Specifically, the spindle 50 does not extend beyond the bolts 53, but rather the first threaded portion 55 is provided between the bolts 53 and the base element 46. In particular, the spindle 50 has a length L and the recess 51 has a depth D, both measured in the direction of the rotation axis 38 of the damper shaft 32 (as illustrated in FIG. 5B), with the depth D comprising at least 50%, preferably at least 60% and more preferably at least 70% of the length L of the spindle 50. This configuration further enhances the overall strength of the spindle 50 and thus its durability.

As shown in FIGS. 1A and 1B, the hydraulic damper mechanism comprises a one-way valve 58 which allows the hydraulic fluid to flow from the low pressure compartment 43 of the cylinder cavity 40 to the high pressure compartment 42 thereof when the closure member 1 is opened. The opening movement of the closure member 1 is therefore not damped or at least to a smaller extent than the closing movement. In the illustrated embodiments, this one-way valve 58 is provided in the piston 41.

To achieve the damping action upon closing of the closure member 1 by the energy storing mechanism, at least one restricted fluid passage is provided between the two compartments 42, 43 of the cylinder cavity 40. One restricted fluid passage is formed by a channel 59 connecting, in all the possible positions of the piston 41, i.e. in all positions between its two extreme positions, the low pressure compartment 43 with the high pressure compartment 42 thereof. This channel 59 is provided with an adjustable valve 60, in particular a needle valve, so that the flow of hydraulic liquid through this channel 59 can be controlled.

The channel 59 could be provided in the cylindrical wall of the fixed hinge member 4, but, in the illustrated embodiments, this channel 59 is provided in a tubular member 61 that is integrally formed with the oil cap 39 at and end of the cylinder cavity 40 that is closed off by a first end cap 87. The tubular member 38 projects into the cylinder cavity 40 in the longitudinal direction 11 thereof. The needle of the adjustable valve 60 is screwed through an opening in the oil cap 39 into the tubular member 61 so that the adjustable valve 60 is adjustable from the outside upon removal of the first end cap 87.

The channel 59 in the tubular member 61 has a first opening 62 ending above the piston 41 in the low pressure compartment 43 of the cylinder cavity 40 and two second openings 63 ending below the piston 41 in the high pressure compartment 42 of the cylinder cavity 40.

The tubular member 61 further comprises a second channel 64 that has a first opening 65 about midway of the tubular member 61 and the two second openings 63 ending below the piston 41. When the piston 41 approaches its most downward extreme position, hydraulic fluid can flow along the second channel 64 from the high pressure compartment 42 of the cylinder cavity 40 to the low pressure compartment 43 thereof. As such, the second channel 64 forms a by-pass which causes an increase of the closing speed at the end of the closing movement, i.e. a final snap, to ensure that the closure member 1 is reliably closed. A second adjustable valve 66, in particular a needle valve, is provided so that the flow of hydraulic liquid through the channel 64 can be controlled to control the closing speed of the closure member 1 during the final snap.

The operation of the energy storing mechanism and the damper mechanism will be explained with respect to FIGS. 2A to 2D for a right-handed closure member 1 and with respect to FIGS. 3A to 3D for a left-handed closure member 1.

Figure 2A:
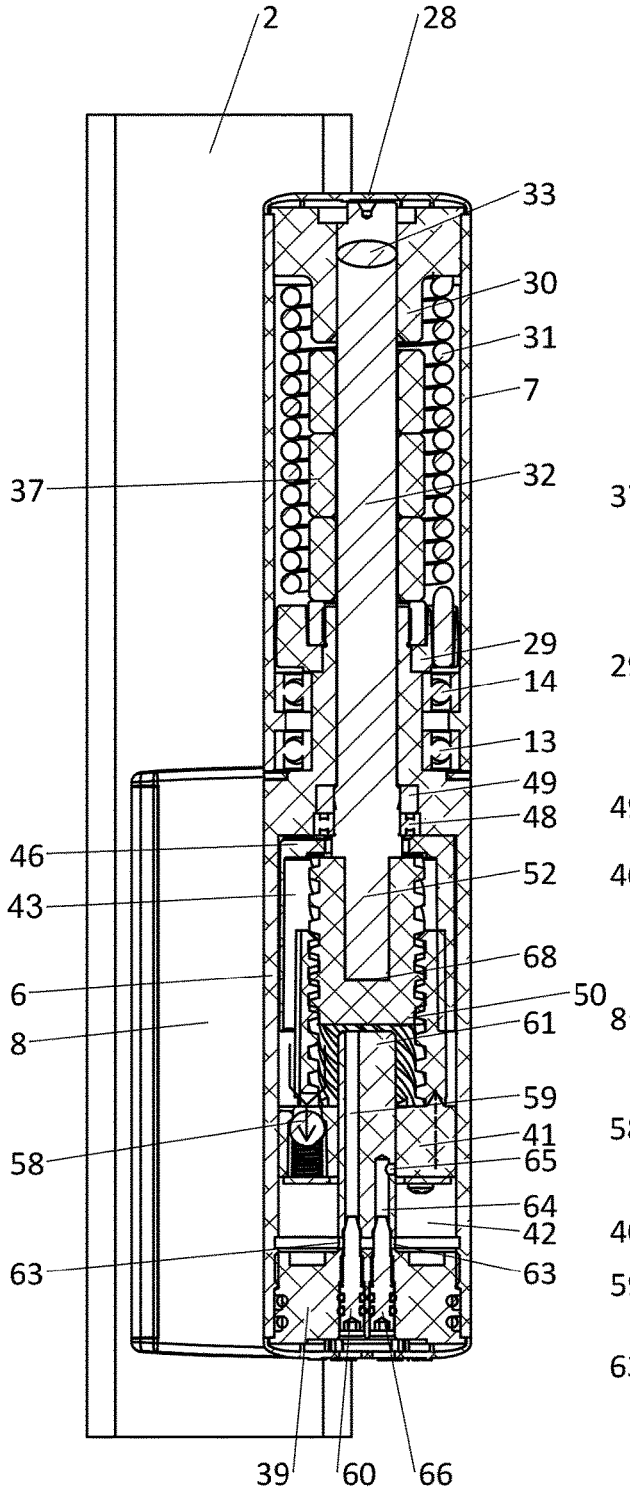
FIGS. 2A to 2D show the same longitudinal cross-section as FIG. 1A with the closure member being opened over 90°; fully opened over 180°; and starting to close; and half closed over 90°.
Figure 2B:
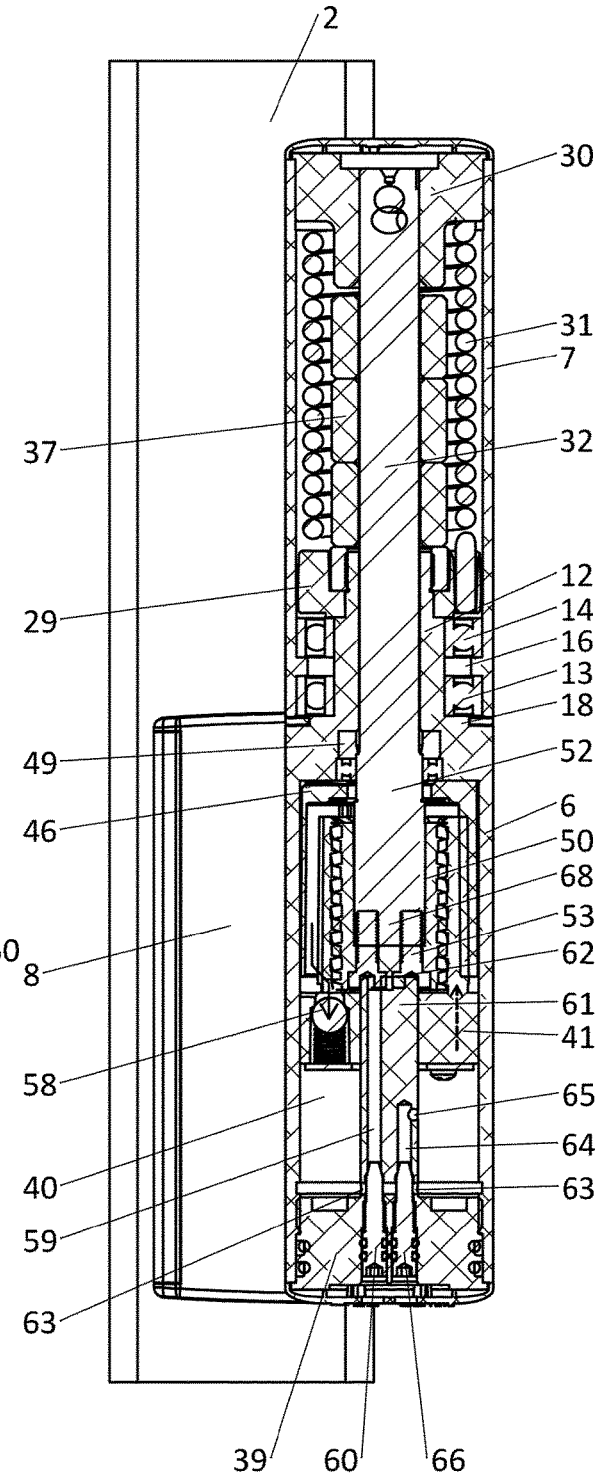
Figure 3A:
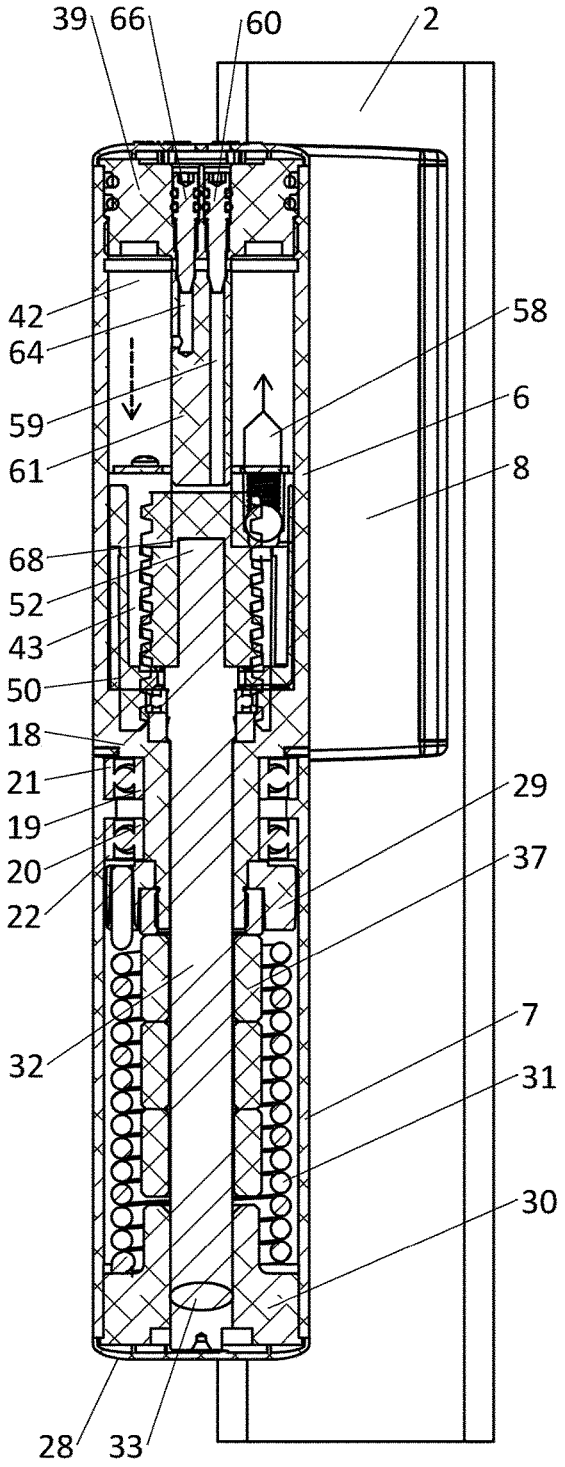
FIGS. 3A to 3D show the same longitudinal cross-section as FIG. 1B with the closure member being opened over 90°; fully opened over 180°; and starting to close; and half closed over 90°.
Figure 3B:
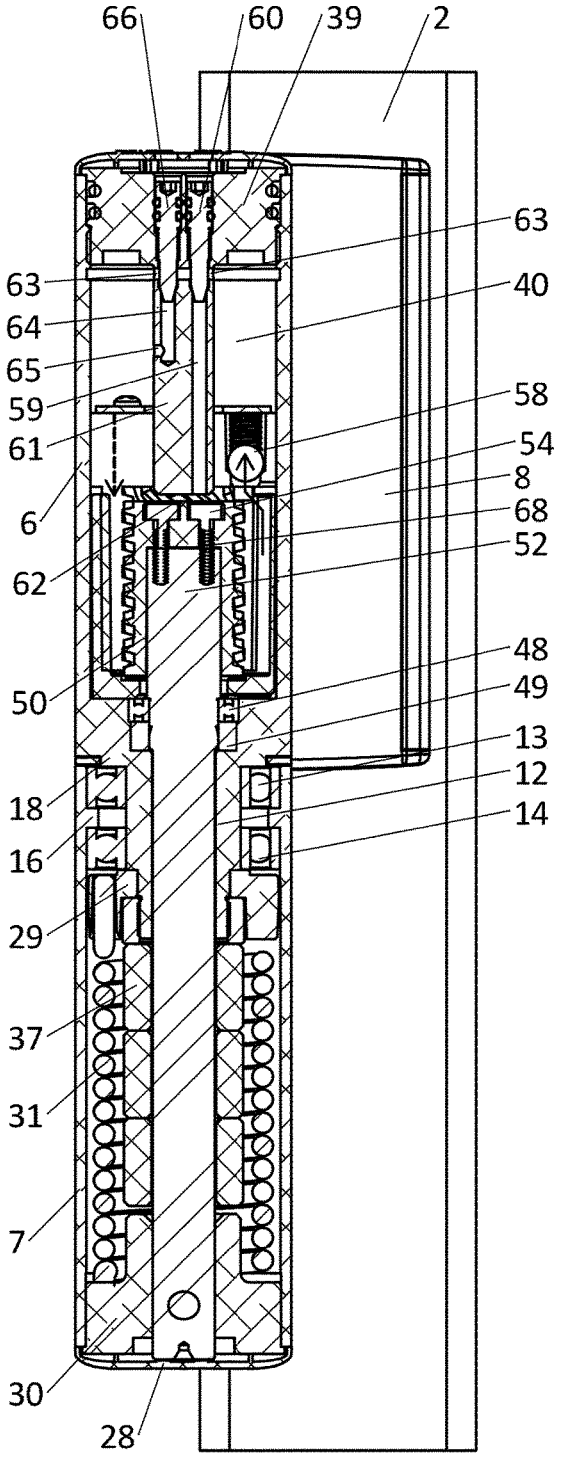

FIGS. 2A and 3A show a cross-sectional view of a right-handed and a left-handed closure member 1 respectively when it is halfway opened, e.g. when the closure member 1 has been rotated approximately 90° with respect to the support 2. When comparing with FIGS. 1A and 1B respectively, it is clear that the first actuation member 29 has remained stationary, while the second actuation member 30 has rotated over 90° thereby storing energy in the torsion spring 31. The damper shaft 32 has transferred the same rotation to the damping mechanism causing the piston 41 to move towards the damper shaft 32 as indicated by the dashed arrow. As the cylinder cavity 40 is filled with hydraulic fluid, the motion of the piston 41 results in a motion of the hydraulic fluid (indicated by the full arrow) across the one-way valve 58 from the low pressure compartment 43 to the high pressure compartment 42. It will be appreciated that the hydraulic fluid may also pass to some extent via the restricted fluid passage formed by channel 59. These motions continue until the closure member 1 is fully opened over 180° as illustrated in FIGS. 2B and 3B respectively.

Figure 2C:
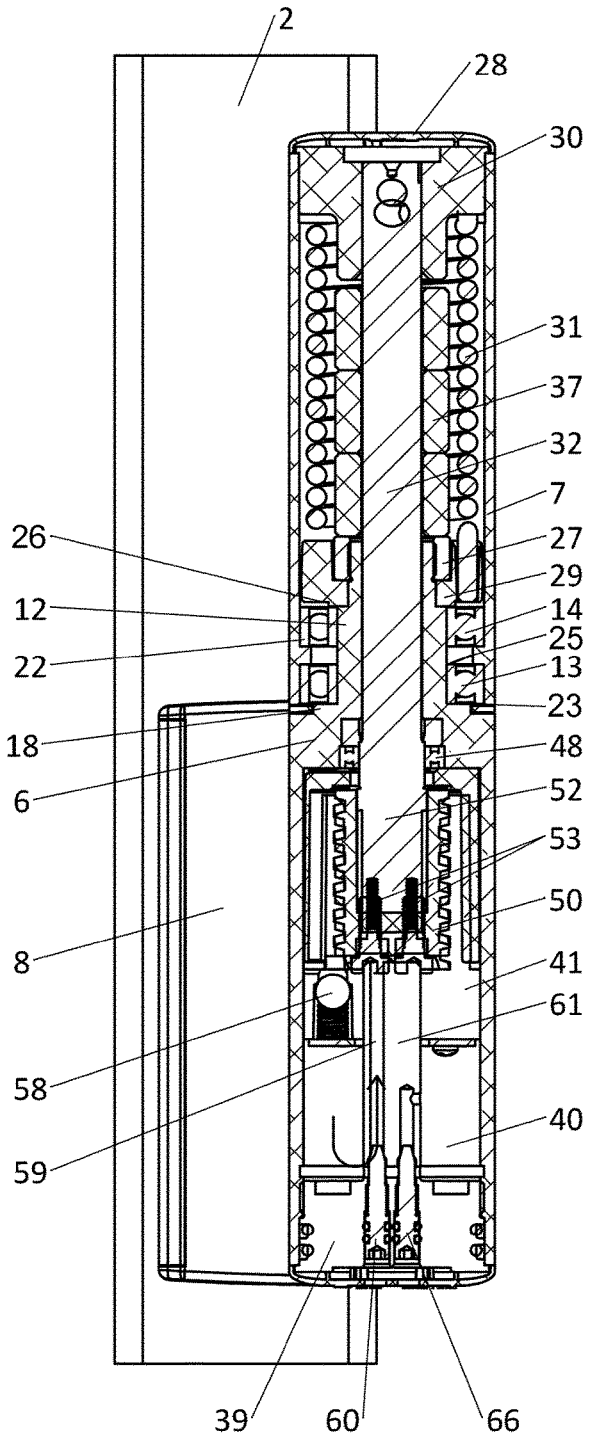
Figure 2D:
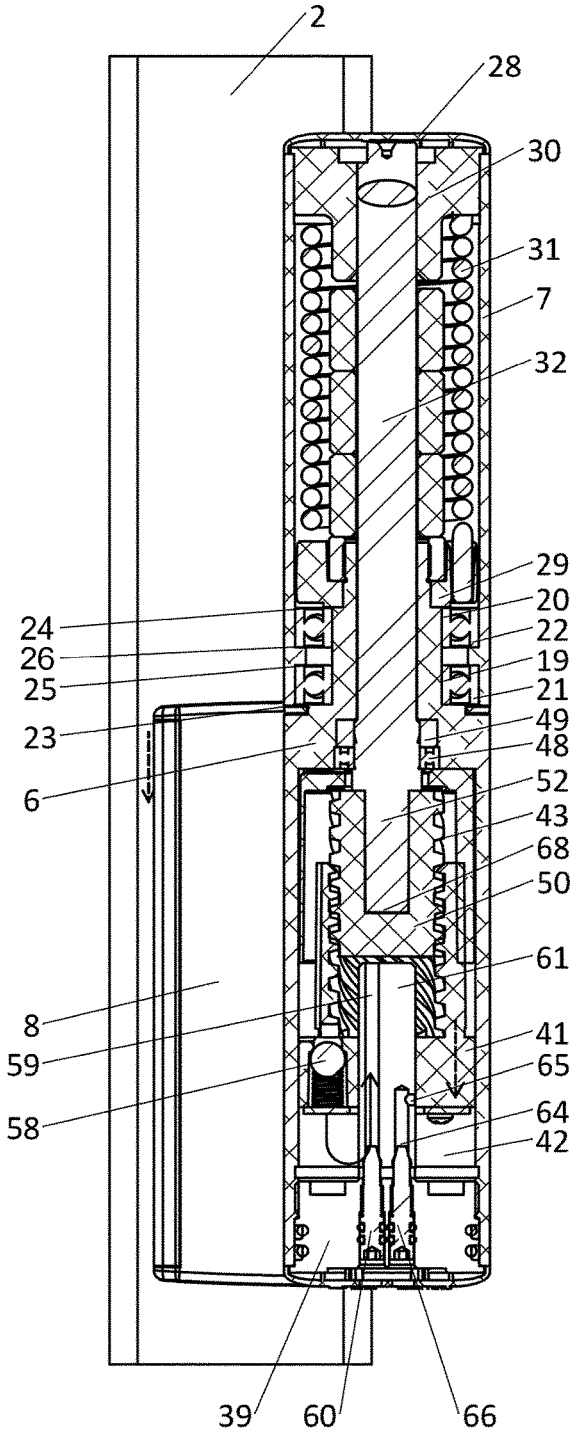
Figure 3C:
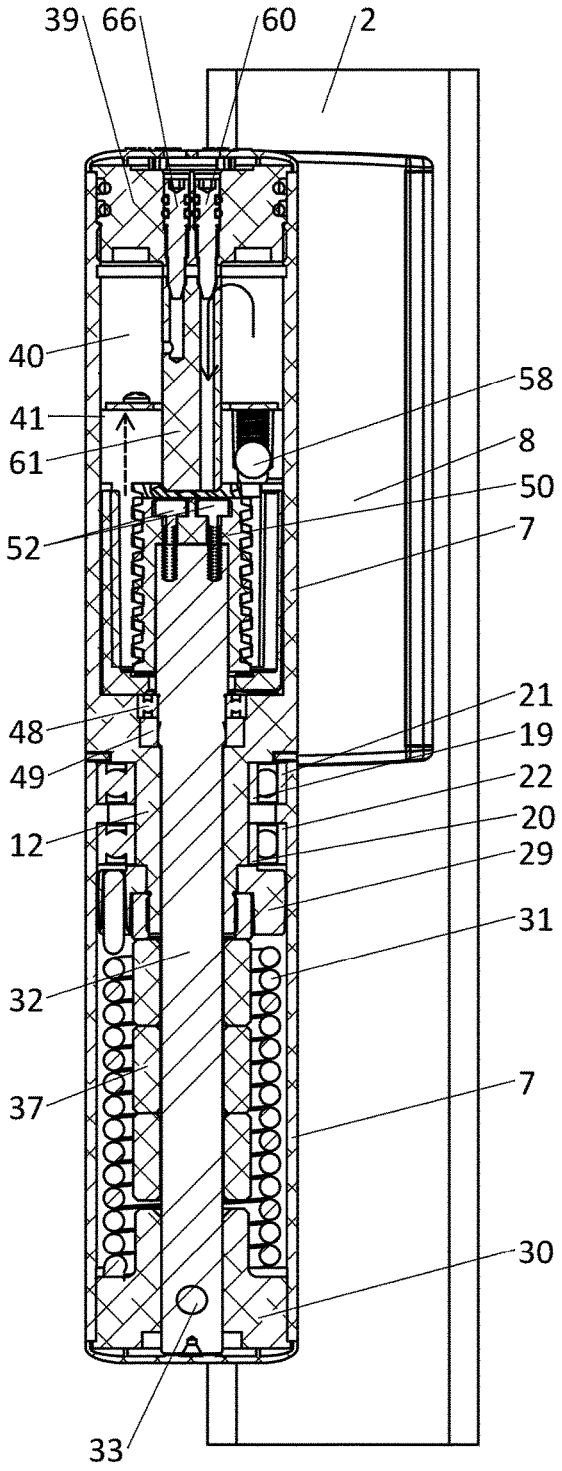
Figure 3D:
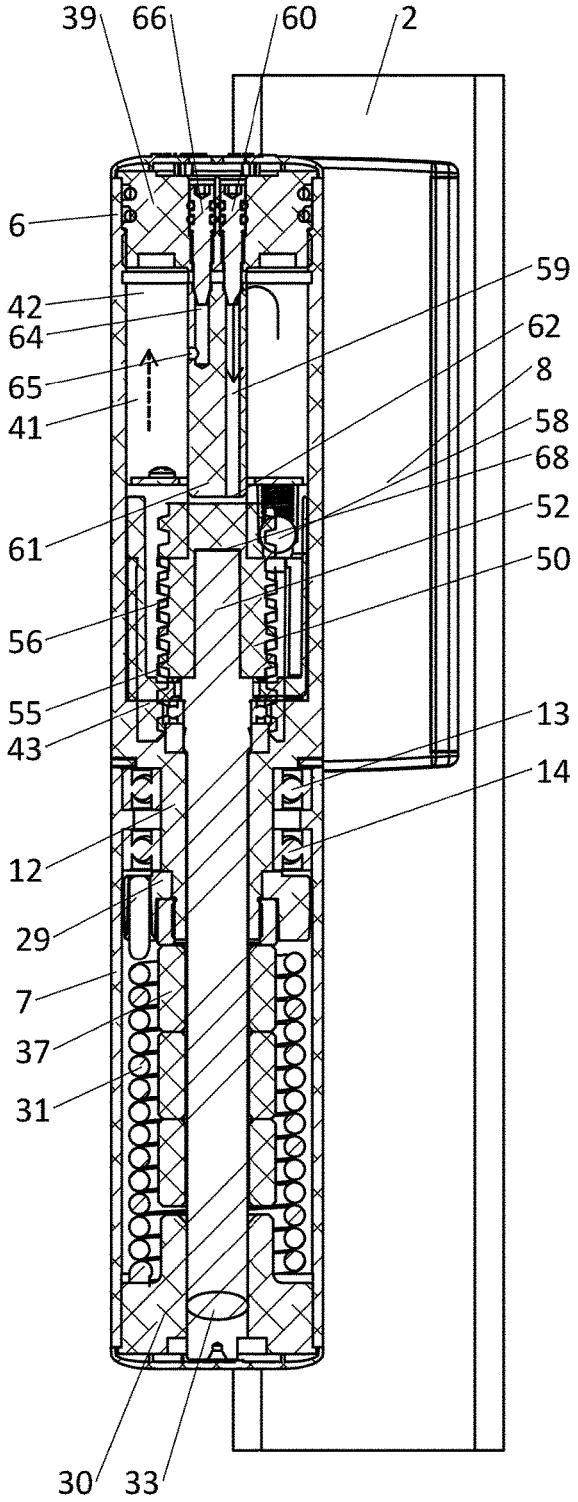

FIGS. 2C and 3C illustrate the fully opened position of a right-handed and a left-handed closure member 1 respectively. The energy that was stored in the spring 31 is now restored to close the closure member 1. Specifically, the spring 31 urges the second actuation member 30 to move relative to the first actuation member 29. Because the second actuation member 30 is fixed to the damper shaft 32 and the moveable hinge member 5, these are also urged to rotate. The damper shaft 32 transfers this rotation to the piston 41 which is now moved away from the damper shaft 32 as indicated by the dashed arrow. The one-way valve 58 is now shut and the hydraulic fluid is forced through the restricted fluid passage formed by channel 59 in the tubular member 61. This restricted flow thus damps the closing movement. These motions continue as illustrated in FIGS. 2D and 3D which show the closure member 1 half closed, e.g. rotated over approximately 90° degrees. It is clear from FIGS. 2D and 3D that when the piston 41 continues to move away from the damper shaft 32, the first opening 65 of the second channel 64 in the tubular member 61 will not be blocked by the piston 41 anymore allowing hydraulic fluid to flow from the high pressure compartment 42 to the low pressure compartment 43 to decrease the damping to reliably close the closure member 1.

The hinge described above is mainly used outdoors where large temperature variations are not uncommon. For example, summer temperatures up to 70° C. when the hinge is exposed to sunlight and winter temperatures below −30° C. are not uncommon, i.e. temperature variations up to and possibly even exceeding 100° C. are possible. Moreover, there are also daily temperature variations between night and day which can easily exceed 30° C. when the hinge is subjected to direct sunshine. These temperature variations cause expansion, and also contraction, of the hydraulic fluid, which could affect the operation of the damping mechanism. In particular, the expansion due to temperature variations can be up to 1% of the volume of hydraulic fluid for a temperature variation of 10° C., depending on the expansion coefficient of the hydraulic fluid. As such, an expansion of, for example, up to 3 cc for a temperature difference of 50° C. is possible.

To counter this expansion, a small amount of gas such as air could be provided in the hydraulic fluid itself. However, it has been found that this gas may interfere with the good working of the hinge, especially when gas bubbles, or an emulsion of the gas in the hydraulic fluid, passes through the restricted flow passage and provides a smaller damping effect than pure hydraulic fluid. Consequently, the hydraulic fluid is preferably free of gas bubbles.

In the hinge illustrated in the drawings, expansion of the hydraulic fluid is therefore countered by means of an expansion channel 69 with a moveable plunger 70 therein as shown in FIGS. 7A, 7B, 8A and 8B. The plunger 70 divides the expansion channel 69 into a first compartment 71 having a first volume that is in fluid communication with the cylinder cavity 40 via a fluid channel 75 and a second compartment 72 having a second volume. The plunger 70 has a ring-shaped seal 73 on its outside to prevent leaks between the hydraulic fluid and the pressure relief compartments 71, 72. As such, the plunger 70 acts a moveable seal. It will be readily appreciated that multiple ring-shaped seals 73 may also be provided. When the hinge is exposed to a temperature increase, the volume of the hydraulic fluid increases pushing the plunger 70 deeper into the expansion channel 69 and when the volume of the hydraulic fluid decreases, the plunger 70 is sucked back to close the expansion channel 69.

Figure 6A:
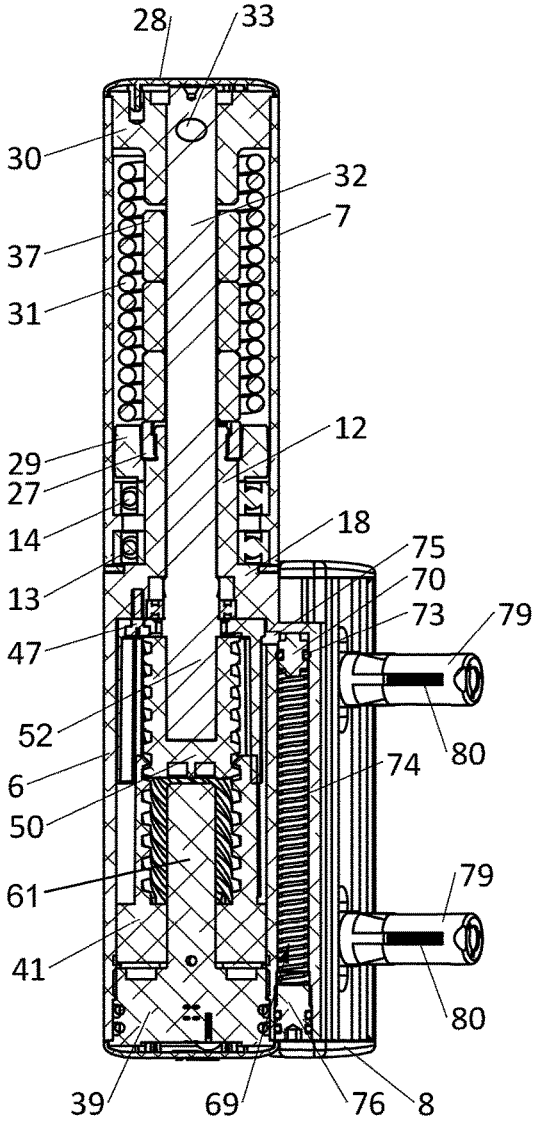
FIGS. 6A and 6B show a longitudinal cross-section of the hinge at the location of the expansion channel present therein.
Figure 6B:
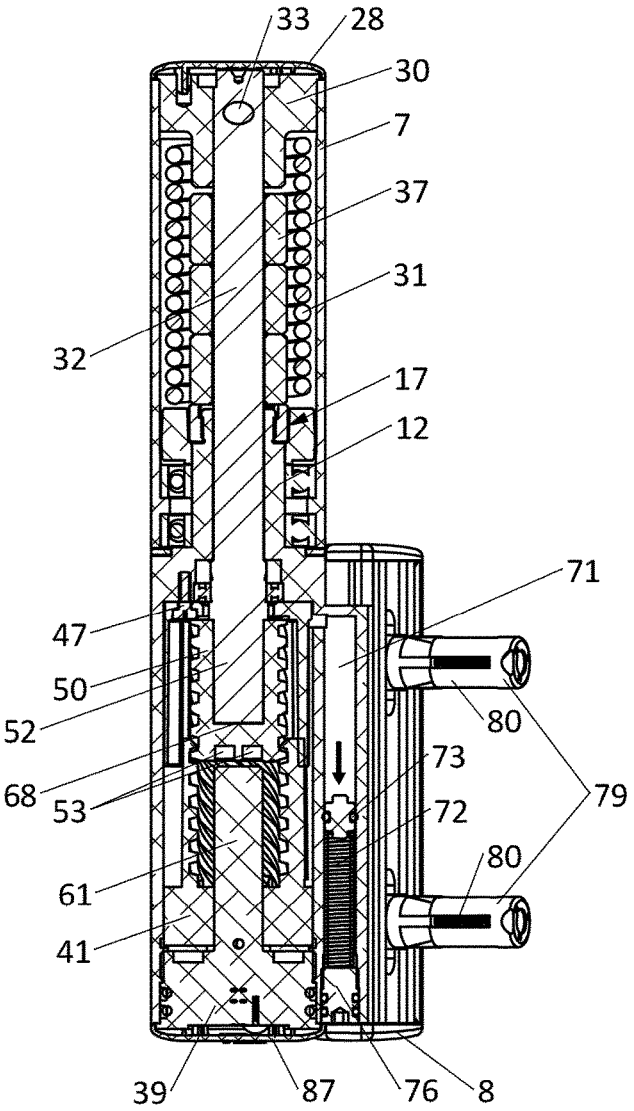
Figure 7A:
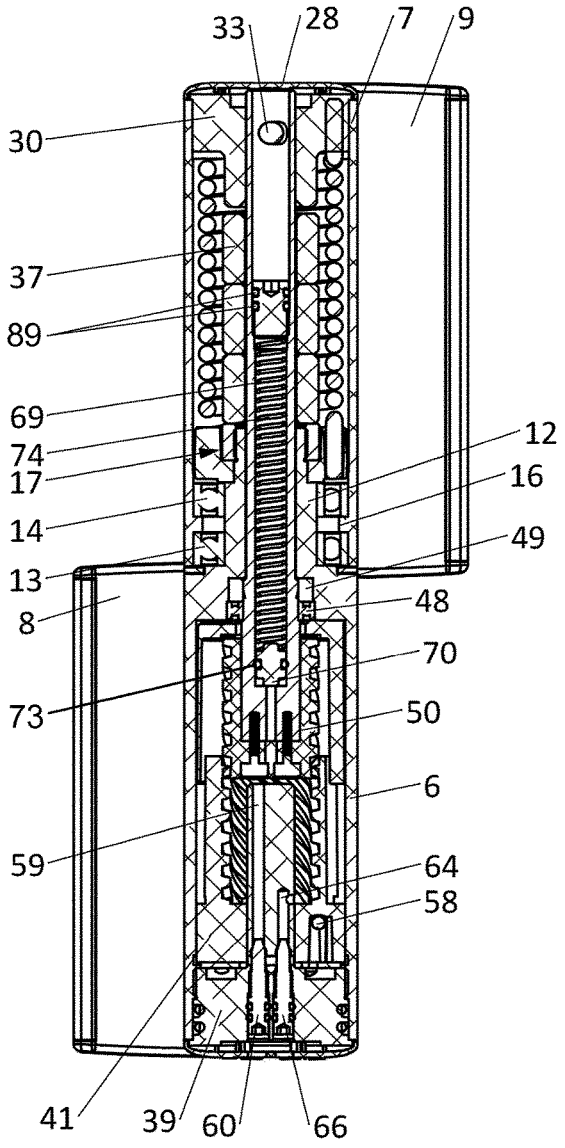
FIGS. 7A and 7B show a longitudinal cross-section at the location of an alternative expansion channel of the hinge.
Figure 7B:
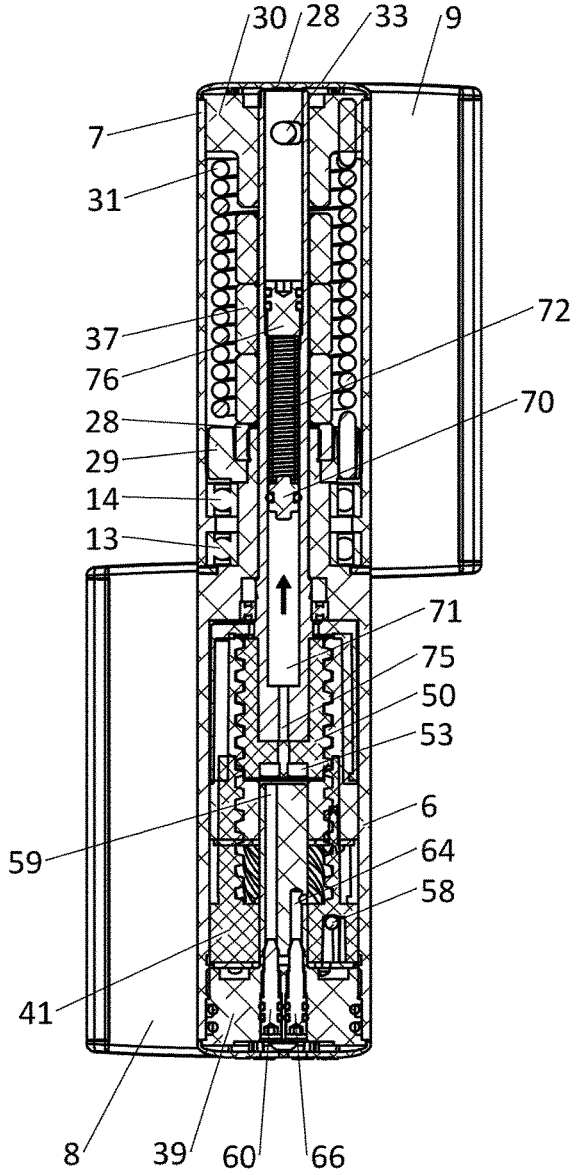

Turning to FIGS. 6A and 6B the expansion channel 69 is provided adjacent to the fixed barrel 6, i.e. it is formed as a part of the fixed leaf 8. In an alternative embodiment, illustrated in FIGS. 7A and 7B, the expansion channel 69 is provided in the damper shaft 32. In both embodiments, the first compartment 71 is in fluid communication with the low pressure compartment 43 of the cylinder cavity 40. As such, the plunger 70 is not exposed to the high pressures that result from the normal operation of the damping mechanism. This is advantageous as, exposing the first compartment 71 to the high pressure compartment 42 would affect the closing movement of the closure member 1, i.e. the hydraulic fluid would not only flow via the channel 59 but would also enter the first compartment 71 by displacing the plunger 70.

In the illustrated embodiments, the second compartment 72 is also provided with a biasing member formed by a compression spring 74 and an end cap 76 that seals off the expansion channel 69 from the outside, by two sealing rings 89, and that urges the plunger 70 towards the fluid channel 75. The effect of this spring 74 is that the hydraulic fluid is pressurised so that negative pressures in the hydraulic fluid are alleviated. Specifically, the hydraulic fluid is usually added at room temperature, e.g. near 20° C. When the hinge is exposed to temperatures down to −30° C. a negative pressure would occur in the hydraulic fluid in the absence of the compression spring 74. When the hinge is first exposed to temperatures up to 70° C., and then cooled down to a low temperature, the increased friction between the ring-shaped seal 73 and the expansion channel 69 (as a result of the fact that the seal becomes less flexible at lower temperatures) could result, in absence of the compression spring 74, in an additional negative pressure in the hydraulic fluid which could result in air getting sucked into the cylinder cavity 40 via the seal 49 around the damper shaft 32 or via the seal 73 on the plunger 70. This problem is solved by the compression spring which pressurizes the hydraulic fluid, even at low temperatures, so that any risk of air being sucked into the cylinder cavity being avoided.

In the illustrated embodiments, the pressure relief compartment 76 is filled, besides the compression spring 74, with air and is closed off by the end cap 76. When, the end cap 76 provides an airtight seal, the gas in the pressure relief compartment 76 could be pressurised to assist or replace the compression spring 74.

The volume of the expansion channel 69 and the first and second volumes are mainly determined in function of the expected increase in volume of the hydraulic fluid. In the illustrated embodiments, the first volume is preferably at least 1.5 cc, more preferably at least 2 cc, advantageously at least 2.5 cc and more advantageously at least 3 cc when the plunger 70 is pushed as far back as possible into the expansion channel 69, i.e. when the first volume is maximal. The maximal second volume is preferably substantially the same as the maximal first volume to provide enough space for the compression spring 74.

It will be readily appreciated that, in other embodiments, the first hinge member 4 may be fixed to the closure member 1 and the second hinge member 5 may be fixed to the support 2 without modifying the internal structure of the hinge as described above.

Although aspects of the present disclosure have been described with respect to specific embodiments, it will be readily appreciated that these aspects may be implemented in other forms.

The invention claimed is:

1. A hydraulically damped, self-closing hinge for hinging a closure member to a support, the hinge comprising:

a first hinge member comprising a first barrel and a first leaf fixed to said first barrel and configured to be fixed to one of: the support and the closure member;

a second hinge member pivotably mounted on the first hinge member through an intermediary of a first and a second rolling bearing, the second hinge member comprising a second barrel and a second leaf fixed to said second barrel and configured to be fixed to the other one of: the support and the closure member;

a damping mechanism interposed between said hinge members and configured for damping a closing movement of said closure member, the damping mechanism comprising:

a closed cylinder cavity that has a longitudinal direction and is filled with a volume of hydraulic fluid;

a damper shaft having a first end extending into the cylinder cavity;

a piston within said cylinder cavity, the piston dividing the cylinder cavity into a high pressure compartment and a low pressure compartment, the piston being operatively coupled to said damper shaft to be movable between two extreme positions in said longitudinal direction;

a one-way valve allowing fluid flow from the low pressure compartment to the high pressure compartment when said closure member is being opened; and at least one restricted fluid passage between the compartments; and an energy storing mechanism interposed between said hinge members and configured to store energy when said closure member is being opened and to use said energy to effect closure of said closure member, wherein said first barrel has a main body and a hollow shaft extending from said main body with the damper shaft extending through the hollow shaft, the second barrel being pivotably mounted on said hollow shaft through an intermediary of said rolling bearings, each having an inner race and an outer race, the inner races of said rolling bearings radially engaging an outer surface of said hollow shaft, the outer races of said rolling bearings radially engaging an inner surface of said second barrel, the inner race of the first rolling bearing being axially engaged by a first abutment on said first barrel, the inner race of the second rolling bearing being axially engaged by a second abutment fixed onto said hollow shaft, the outer race of the first rolling bearing being axially engaged by a third abutment on the inner surface of said second barrel, the outer race of the second rolling bearing being axially engaged by a fourth abutment on the inner surface of said second barrel.

2. A hinge according to claim 1, wherein said third and fourth abutments are located between said rolling bearings and said rolling bearings are located between said first and second abutments.

3. A hinge according to claim 1, wherein the inner surface of the second barrel has a collar facing an outer surface of said hollow shaft, the third and fourth abutments being formed by two lateral surfaces of the collar.

4. A hinge according to claim 1, wherein said second abutment is formed by a ring that is applied over said hollow shaft.

5. A hinge according to claim 1, wherein said first abutment is formed by a ledge located on an outer surface of said hollow shaft.

6. A hinge according to claim 1, wherein the energy storing mechanism comprises a first and a second actuation member and a spring mechanism arranged between both actuation members, the actuation members being rotatable with respect to one another around a rotation axis in a first mutual direction to store said energy in said spring mechanism and in a second mutual direction, which is opposite to said first mutual direction, to restore said energy.

7. A hinge according to claim 6, wherein the first actuation member is irrotatably fixed to said second barrel and the second actuation mechanism is irrotatably fixed to said first barrel.

8. A hinge according to claim 1, wherein the first and the second rolling bearing are ball bearings.

9. A hinge according to claim 1, wherein said damper shaft is rotatable around a rotation axis that extends in said longitudinal direction with said first end having an end face and a portion with a non-circular cross-section, the damping mechanism comprising a spindle made of a synthetic material and having a recess with a non-circular cross-section fitting onto said portion of the damper shaft, the spindle being fixed onto said first end of the damper shaft and having an outer threaded portion with a screw axis which coincides with the rotation axis of the damper shaft, the piston having an inner threaded portion with a screw axis which also coincides with the rotation axis of the damper shaft, the outer threaded portion of the spindle on the damper shaft being in engagement with the inner threaded portion of the piston to operatively couple the piston to said damper shaft.

10. A hinge according to claim 9, wherein said recess in the spindle has a bottom which engages said end face of the damper shaft, the spindle being fixed to the damper shaft by at least one bolt that is bolted through the bottom of the spindle into the end face of the damper shaft, the at least one bolt having a head which is sunk into the bottom of the spindle and being offset with respect to said rotation axis to irrotatably fasten the spindle to the damper shaft.

11. A hinge according to claim 9, wherein a third rolling bearing is provided between the rotating damper shaft and said first barrel, said third rolling bearing aligning the damper shaft with said hollow shaft.

12. A hinge according to claim 11, wherein the third rolling bearing is a ball bearing.

13. A hinge according to claim 1, wherein the hinge comprises a pressure compensation mechanism configured to compensate changes of the volume of said hydraulic fluid upon temperature variations thereof, the pressure compensation mechanism comprising an expansion channel with a plunger that fits into the expansion channel and is slidably received therein, the plunger dividing the expansion channel into a first compartment that is in fluid communication with said cylinder cavity and a second compartment that is sealed off from the first compartment by said plunger, the second compartment allowing the plunger to slide within the expansion channel to compensate said changes of the volume of the hydraulic fluid.

14. A hinge according to claim 13, wherein said second compartment comprises a biasing member urging the plunger towards said second compartment to pressurize the hydraulic fluid.

15. A hinge according to claim 13, wherein said first compartment of the expansion channel is part of said low pressure compartment.

* * * * *